US006564594B1

(12) United States Patent
Ito et al.

(10) Patent No.: US 6,564,594 B1
(45) Date of Patent: May 20, 2003

(54) DRUM TYPE WASHING MACHINE

(75) Inventors: Masumi Ito, Seto (JP); Fumitaka Yamazaki, Owariasahi (JP); Shinichiro Kawabata, Seto (JP); Kiyomi Sasano, Ichinomiya (JP); Shuji Hashiba, Ena-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 82 days.

(21) Appl. No.: 09/708,920

(22) Filed: Nov. 9, 2000

(51) Int. Cl.[7] ..... D06F 37/04

(52) U.S. Cl. ..... 68/24; 68/25; 68/58; 68/140

(58) Field of Search ..... 68/25, 24, 58, 68/140, 15

(56) References Cited

U.S. PATENT DOCUMENTS

| | | | | |
|---|---|---|---|---|
| 2,279,656 | A | * | 4/1942 | Chamberlin et al. |
| 2,296,260 | A | | 9/1942 | Breckenridge |
| 2,579,309 | A | * | 12/1951 | Dunham |
| 3,509,742 | A | | 5/1970 | Bauer |
| 3,581,527 | A | * | 6/1971 | Smith et al. |
| 3,825,780 | A | * | 7/1974 | Weaver |
| 4,886,990 | A | * | 12/1989 | Barker |
| 5,442,937 | A | * | 8/1995 | Kwon |
| 5,711,171 | A | * | 1/1998 | Uhlin |
| 5,809,809 | A | | 9/1998 | Neumann |
| 5,862,686 | A | | 1/1999 | Skrippek |
| 6,000,248 | A | * | 12/1999 | Erickson et al. |

FOREIGN PATENT DOCUMENTS

| | | | |
|---|---|---|---|
| AU | 252570 | * | 6/1964 |
| DE | Z4157 | * | 7/1956 |
| EP | 0 780 506 | | 6/1997 |
| FR | 1340648 | * | 9/1963 |
| GB | 777854 | * | 6/1957 |
| JP | 55-148596 | | 10/1980 |
| JP | 64-17694 | | 1/1989 |
| JP | 3-16637 | | 4/1991 |
| JP | 11-28298 | | 2/1999 |
| JP | 11-342286 | | 12/1999 |
| JP | 11-347288 | | 12/1999 |

* cited by examiner

*Primary Examiner*—Frankie L. Stinson
(74) *Attorney, Agent, or Firm*—Pillsbury Winthrop LLP

(57) ABSTRACT

A drum type washing machine includes an outer cabinet having a rear wall, a water tub elastically mounted in the cabinet and having a rear wall, a drum type rotating tub provided in the water tub so as to be rotatable about a horizontal axis, and an electric motor provided on the rear wall of the water tub to directly drive the rotating tub. A distance between a portion of the rear wall of the water tub on which the motor is provided and the rear wall of the cabinet is larger than a distance between a distance between another portion of the rear wall of the water tub and the rear wall of the cabinet.

18 Claims, 10 Drawing Sheets

DRUM TYPE WASHING MACHINE

BACKGROUND OF THE INVENTION

1. Field of the Invention

This invention relates generally to a drum type washing machine provided with a rotating tub rotatable about a horizontal axis, and more particularly to such a drum type washing machine in which the rotating tub is directly rotated by an electric motor.

2. Description of the Prior Art

There have conventionally been provided drum type washing machines comprising an outer cabinet, a water tub elastically mounted on a plurality of suspension mechanisms in the cabinet, and a rotating tub mounted in the water tub so as to be rotatable about a horizontal axis. Bearings are provided in the rear of the water tub to support a shaft of the rotating tub. The shaft has a rear end on which a driven pulley is mounted. An electric motor is disposed below the water tub and has a shaft on which a driving pulley is mounted. A transmission belt extends between the driving and driven pulleys. Upon rotation of the shaft of the motor, torque is transmitted through the driving pulley and the belt to the driven pulley so that the rotating tub is rotated.

However, provision of the above-described belt transmission mechanism including the driving and driven pulleys and the transmission belt complicates the construction of the washing machine and accordingly increases a manufacturing cost. Further, the driving and driven pulleys and the transmission belt produce vibration or oscillation during transmission of the motor torque. A high speed rotation of the motor particularly causes the transmission belt to slip such that the belt swings. The swinging of the belt increases an amount of vibration produced in the belt transmission mechanism, resulting in production of loud noise.

To solve the above-described problems, Japanese Patent Publication No. 10-201993 (1998) discloses a drum type washing machine comprising an electric motor mounted on a rear wall of the water tub so that the shaft of the rotating tub is directly rotated by the motor. Since no belt transmission mechanism is necessitated in the disclosed washing machine, the construction thereof can be simplified, and the vibration and noise can be reduced. The motor is disposed in a space in the rear of the water tub, in which space the driven pulley and the transmission belt are formerly disposed. In the disclosed washing machine, the motor would collide against the rear wall of the cabinet to be broken when the water tub is caused to swing during drive of the motor to be inclined rearward. Accordingly, the motor needs to be disposed so as to be sufficiently spaced away from the cabinet for the purpose of avoidance of collision against the rear wall of the cabinet. This requires a large space in the rear of the wash tub and accordingly increases a depth of the cabinet.

Furthermore, the drum type washing machine is conventionally installed on a waterproof pan. Sizes of the waterproof pans are standardized according to the sizes of the drum type washing machines. Accordingly, when the depth of the cabinet is increased as described above, the standardized waterproof pans cannot be used.

SUMMARY OF THE INVENTION

Therefore, an object of the present invention is to provide a drum type washing machine in which an increase in the depth of the cabinet can be prevented or at least restrained as the result of disposition of the motor on the rear of the water tub.

The present invention provides a drum type washing machine comprising an outer cabinet having a rear wall, a water tub elastically mounted in the cabinet and having a rear wall, a drum type rotating tub provided in the water tub so as to be rotatable about a horizontal axis, and an electric motor provided on the rear wall of the water tub to directly drive the rotating tub, a fixed portion prevented from swinging when the motor is driven, and a contact portion coming into contact with the fixed portion earlier than the motor when the motor is driven such that the water tub swings, the contact portion being provided on the water tub or a member fixed to the water tub except the motor, wherein a distance between a portion of the rear wall of the water tub on which the motor is provided and the rear wall of the cabinet is larger than a distance between another portion of the rear wall of the water tub and the rear wall of the cabinet.

According to the above-described construction, the depth of a portion of the cabinet on which the motor is not disposed can be prevented from being increased while a space for the motor is ensured between the rear wall of the water tub and the cabinet. Further, breakage of the motor can be prevented or at least restrained even if the water tub swings.

The portion of the rear wall of the water tub on which the motor is provided is preferable formed into the shape of a recess. At least a part of the motor is located in the recess of the rear wall of the water tub, so that the rear wall of the cabinet can be brought close to the rear wall of the water tub. Consequently, the depth of the cabinet can be reduced.

The motor preferably comprises an outer rotor type motor. In order that the same torque may be obtained from an inner rotor type motor as from an outer rotor type motor having an outer diameter equal to one of the inner rotor type motor, an axial dimension of the inner rotor type motor needs to become larger than one of the outer rotor type motor. More specifically, since the outer rotor type motor is employed in the above-described construction, the axial dimension of the motor can be reduced. Consequently, the disposition of the motor on the rear wall of the water tub can reduce the depth of the cabinet.

The drum type washing machine preferably further comprises a fixed portion prevented from swinging when the motor is driven and a contact portion coming into contact with the fixed portion earlier than the motor when the motor is driven such that the water tub swings, the contact portion being provided on the water tub or a member fixed to the water tub except the motor. The breakage of the motor can be prevented or at least restrained even if the water tub swings.

The drum type washing machine preferably further comprises a rotational shaft connecting the rotating tub and the motor to each other and a bearing supporting the rotational shaft. In this washing machine, the bearing has a portion located inside a stator of the motor. Since an inner space of the stator is utilized for the provision of the bearing, an increase in the depth of the cabinet can further be prevented.

The rear wall of the cabinet preferably includes a portion opposed to the motor and formed with a vent hole. Since air flows through the vent hole between the interior and the exterior of the cabinet, heat dissipation from the motor can be improved.

The motor preferably includes a rotor provided with a plurality of blowing blades for a cooling operation. Since air flows around the motor by the blowing action of the blades, the heat dissipation can be improved.

The rear wall of the cabinet preferably has an opening, and the washing machine further comprises a back panel detachably attached to the cabinet so as to close the opening. The back panel includes a portion opposed to the motor and formed with an outwardly protruding convexity. At least a part of the motor is disposed in the convexity such that the rear wall of the cabinet can accordingly be positioned forward. Consequently, the increase in the depth of the cabinet can be prevented or at least restrained.

The drum type washing machine preferably further comprises a unit configured to heat provided on a lower portion of the water tub for heating water reserved in the water tub and a hole formed in a lower portion or a side of the convexity of the back panel so as to communicate with an interior and an exterior of the cabinet. Since air in the cabinet heated by the unit is discharged through the hole outside the cabinet, the convexity can be prevented from being filled with hot air and accordingly, the motor can be prevented from being adversely affected by the heat. Further, since the hole is located in the lower portion or the side of the convexity of the back panel, water can be prevented from entering the cabinet through the hole when the water splashes on the convexity.

The motor preferably includes a portion located in the convexity. Consequently, the depth of the cabinet can be reduced.

The back panel is preferably pressed so that the convexity is tapered and the convexity has a hole formed in a lower portion or a side of a peripheral wall thereof so as to communicate with an interior and an exterior of the cabinet. Since the convexity is formed integrally with the back panel, the back panel has no joints. Further, since the convexity is tapered, air tends to easily flow along an inner face of the convexity such that hot air can be prevented from filling the interior of the convexity.

The hole is preferably provided with a louver. Consequently, water or foreign matters can be prevented from entering the cabinet through the hole, and an amount of noise produced by the motor and leaking from the hole can be reduced.

A washing machine is usually installed on a waterproof pan. The waterproof pan for automatic washing machines such as drum type washing machines has a standard size of 540 mm×540 mm. In view of the circumstances, the cabinet preferably includes a lower portion having a length set at or below 540 mm. Even if the depth of the cabinet is increased as the result of disposition of the motor on the rear wall of the water tub, the washing machine can be installed on the standardized waterproof pan.

DETAILED DESCRIPTION OF INVENTION EMBODIMENTS

Figure 1:
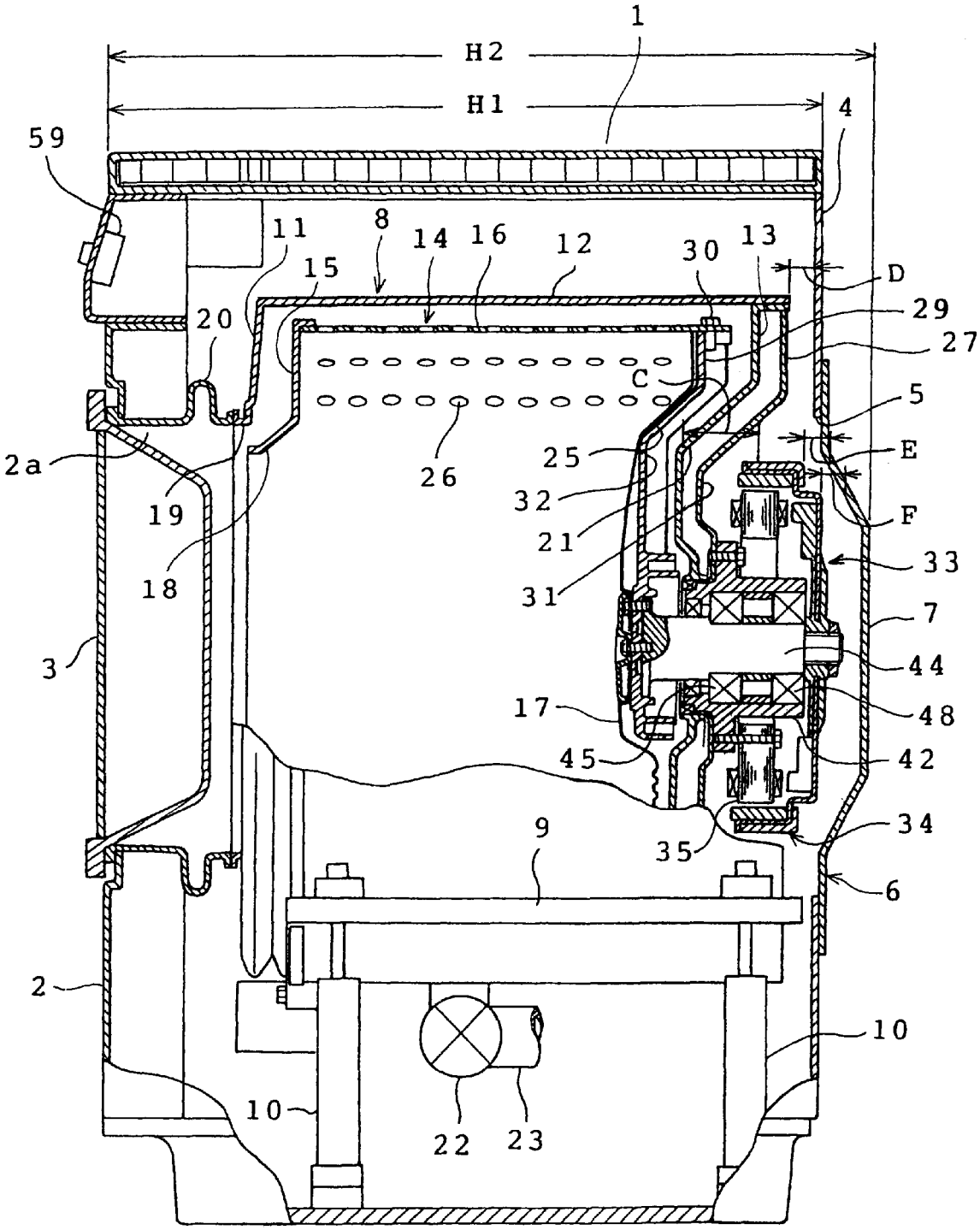
FIG. 1 is a longitudinally sectional side view of a drum type washing machine in accordance with at least one embodiment of the present invention.

A first embodiment of the present invention will be described with reference to FIGS. 1 to 3. Referring to FIG. 1, a drum type washing machine of the first, embodiment in accordance with the invention is shown. The washing machine comprises an outer cabinet 1 formed into the shape of a generally rectangular box. The cabinet 1 includes a front wall 2 having a substantially central access hole 2*a* through which laundry is put into and taken out of a rotating tub 14. A door 3 is mounted on the front wall 2 to close and open the access hole 2*a*. The cabinet 1 further includes a rear wall 4 having a substantially central working hole 5. A back panel 6 is detachably mounted on the rear wall 4 by screws (not shown) so as to close the working hole 5. The back panel 6 includes a rearwardly extruding convexity 7 formed by pressing the back panel 6 except its peripheral portion serving as a mounting portion to the rear wall 4. A peripheral dimension of the convexity 7 is gradually decreased rearward.

A drum-shaped water tub 8 made of, for example, plastic is provided in the cabinet 1. The water tub 8 is elastically supported on support plates 9 (one of them being shown in FIG. 1) further supported on a plurality of, for example, four suspension mechanisms (two of them being shown) mounted on the bottom of the cabinet 1. The water tub 8 includes a front end plate 11, a body 12 and a rear end plate 13. The front end plate 11 has a substantially central opening 19. Bellows 20 connect the access hole 2*a* of the cabinet 1 to the opening 19 of the water tub 8. The rear end plate 13 of the water tub 8 has a recess 21 depressed frontward. A diameter of the recess 21 is gradually decreased frontward. The recess 21 has a generally flat innermost portion. The water tub 8 has a drain hole (not shown) formed in the bottom thereof. A drain valve 22 is provided in the drain hole and connected to a drain hose 23.

A drum-shaped rotating tub 14 made of, for example, plastic is provided for rotation about a horizontal axis in the water tub 8. The rotating tub 14 serves both as a washing tub and as a dehydrating tub. The rotating tub 14 includes a front end plate 15, a body 16 and a rear end plate 17. The front end plate 15 of the rotating tub 14 has a substantially central opening 18 having a slightly smaller diameter than the opening 19 of the water tub 8. The rear end plate 17 of the rotating tub 14 has a recess 25 formed so as to comply with the recess 21 of the water tub 8. The recesses 21 and 25 are formed so as to be opposed to the convexity 7 of the back panel 6. The rotating tub 14 has a number of through holes 26 formed in the body 16 thereof. The holes 26 serve both as air holes and as water flow passages.

A mechanism for driving the rotating tub 14 will now be described with reference to FIGS. 2 and 3. Referring to FIG.

2, a reinforcing plate 27 made of a metal such as stainless steel is secured by a plurality of bolts 28 (a part of them being shown in FIG. 2) to a rear face of the rear end plate 13 of the water tub 8. Accordingly, a rear face of the reinforcing plate 27 serves as a rear face of the water tub 8 in the embodiment. The reinforcing plate 27 has a recess 31 corresponding to the recess 21 of the water tub 8. A metal rotating tub support 29 is secured to a rear face of the rear end plate 17 by a plurality of bolts 30 one of which is shown in FIG. 1. The support 29 has a larger thickness than the rear end plate 17 and serves to reinforce the rear end plate 17 as well as to support the rotating tub 14. The support 29 has a recess 32 corresponding to the recess 25 of the rotating tub 14.

The recesses 31 and 21 of the reinforcing plate 27 and the water tub 8 have centrally formed holes 49 and 50 respectively. A generally cylindrical bearing housing 54 has a front end inserted in the holes 49 and 50. A plurality of bolts 52 are inserted through mounting portions 42*a* formed on an outer circumferential wall of the housing 42 and screwed into the reinforcing plate 27, whereupon the housing 42 is fixed to the reinforcing plate. One of the bolts 52 is shown in FIG. 2. The housing 42 is located in the recess 31 of the reinforcing plate 27 except a rear portion thereof.

A front bearing 45 and a rear bearing 48 are fitted in the housing 42 with outer and inner collars 46 and 47 being interposed therebetween. A rotational shaft 44 is supported on the front and rear bearings 45 and 48. A sealing member 51 is fitted in the hole 50 of the water tub 8 so as to be located at the front end of the housing 42. As a result, a watertight sealing is provided between the rear end plate 13 of the water tub 8 and the rotational shaft 44. The rotational shaft 44 has a front end secured by a plurality of bolts 54 to generally central portions of the recesses 32 and 25 of the support 29 and the rotating tub 16 respectively. Only one of the bolts 54 is shown in FIG. 2. A cap 55 is fixed by a screw 56 to a generally central portion of the recess 25 of the rotating tub 16 so as to cover heads of the bolts 54.

A stator 35 constituting a brushless motor 33 of the outer rotor type is fixed to an outer circumferential wall of the bearing housing 42. The stator 35 comprises a stator core 36 made by stacking flat rolled magnetic steel sheets and having teeth 36*a* protruding from an outer circumference thereof and windings 38 wound on plastic bobbins 37 mounted on the teeth 36*a*, as shown in FIG. 3. The stator core 36 has a plurality of mounting portions 36*b* formed on an inner circumferential wall thereof. The mounting portions 36*b* have through holes through which bolts 43 are screwed into the mounting portions 42*a* of the bearing housing 42 respectively, whereupon the stator 35 is fixed to the bearing housing 42. Substantially the overall stator 35 is located in the recess 31 of the reinforcing plate 27 as shown in FIG. 1.

Figure 2:
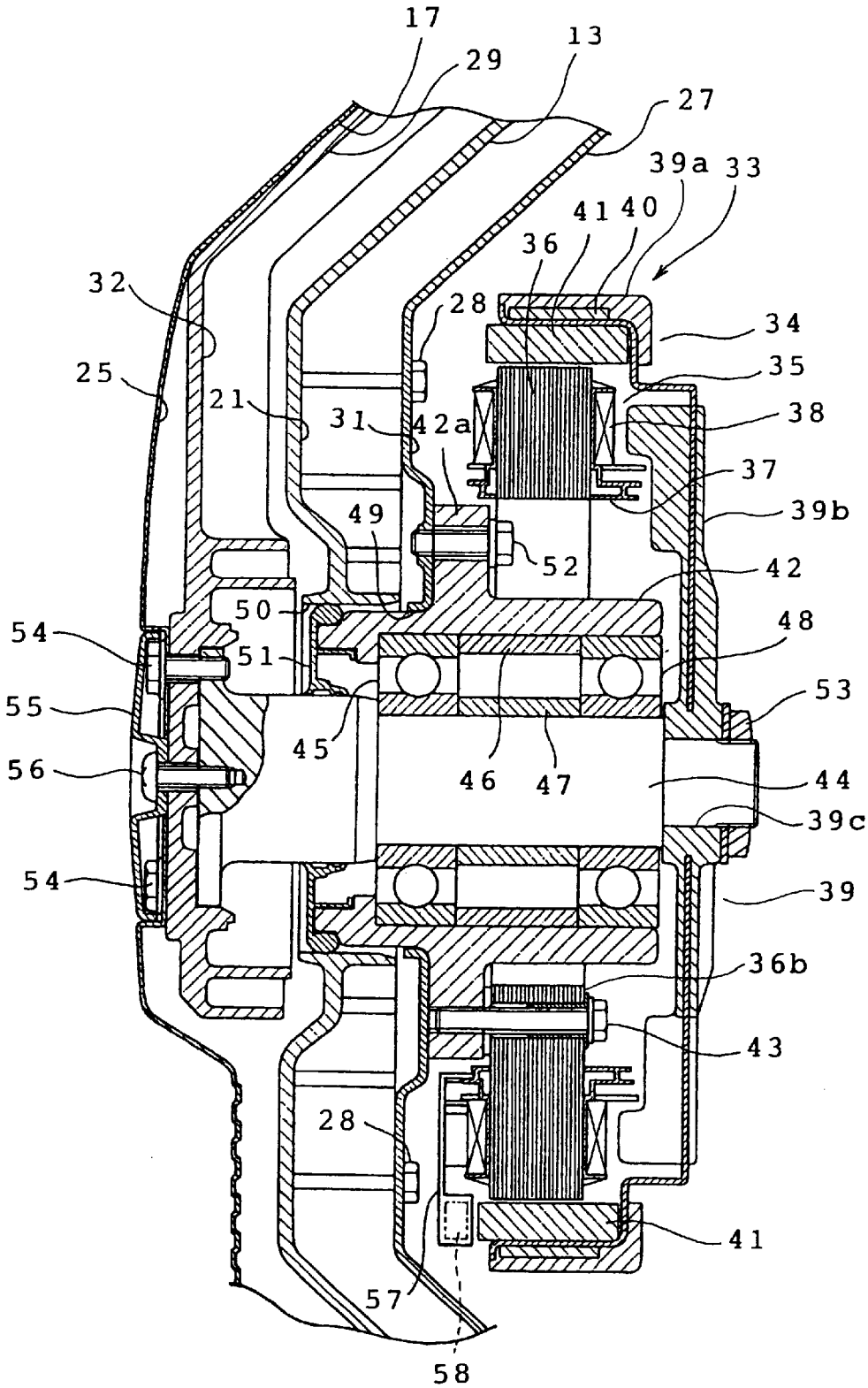
FIG. 2 is an enlarged longitudinal section of a driving mechanism for a rotating tub.
Figure 3:
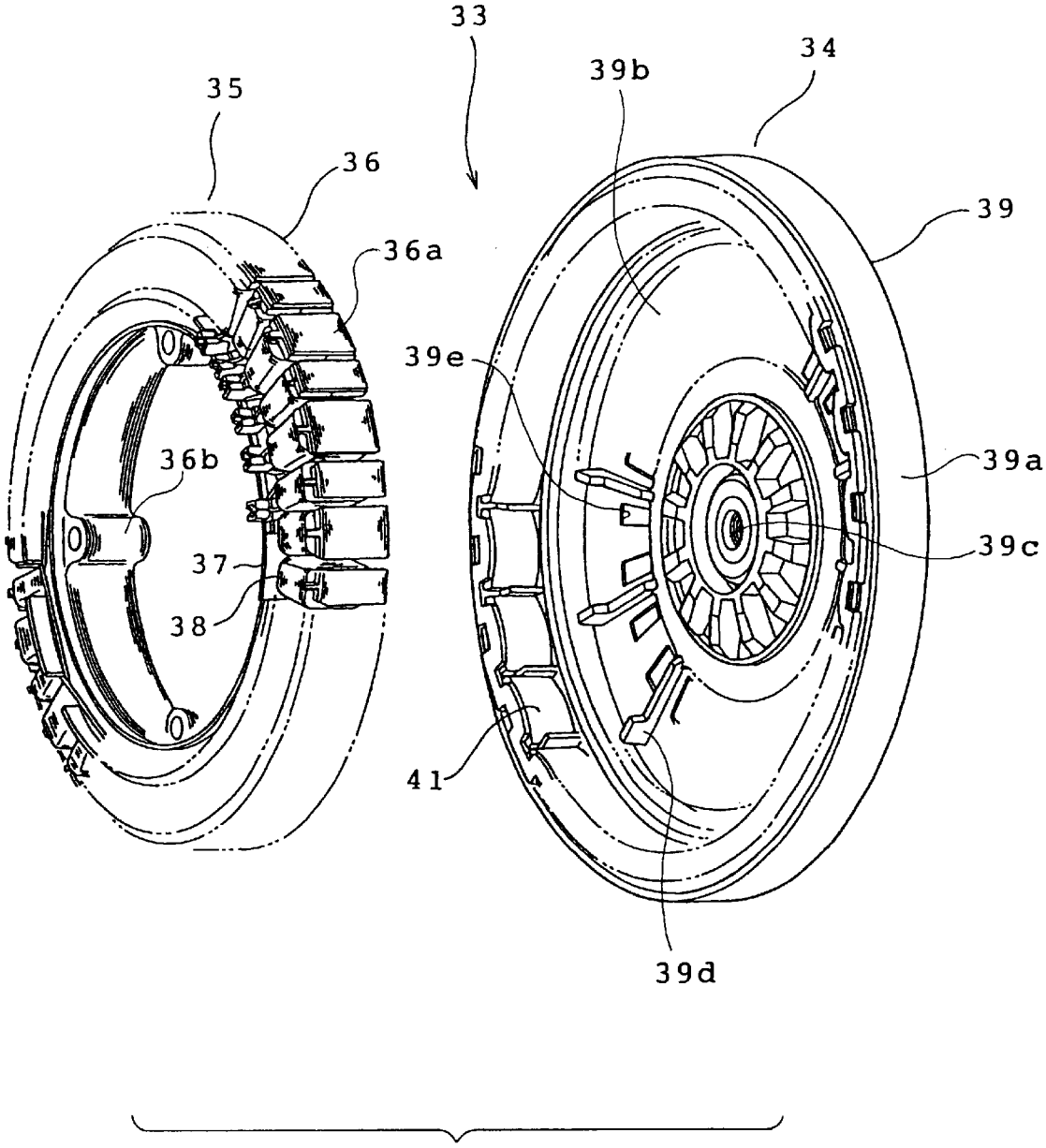
FIG. 3 is an exploded perspective view of an electric motor used in the washing machine.

A rotor 34 constituting the motor 33 is fixed to the rear end of the rotational shaft 44 as shown in FIGS. 2 and 3. The rotor 34 comprises a rotor housing 39, a rotor yoke 40 provided on a circumferential portion 39*a* of the housing 39, and magnetic pole forming magnets 41 secured to an inner circumferential wall of the portion 39*a*. A front half of the rotor 34 is located in the recess 31 of the reinforcing plate 27 as shown in FIG. 1. The rear end of the rotational shaft 44 and the rear end plate 39*b* of the rotor housing 39 are located in the convexity 7 of the back panel 6. The rear end plate 39*b* of the rotor housing 39 has a central hole 39*c* as shown in FIGS. 2 and 3. The rear end of the rotational shaft 44 is fitted in the hole 39*c* with a serration engaging the outer circumferential face of the shaft 44 with the inner circumferential face of the hole 39*c*. A portion of the shaft 44 protruding rearward from the hole 39*c* is fastened by a nut 53.

A plurality of radially extending blowing blades 39*d* protrude from the front of the rear end plate 39*b* of the rotor housing 39. The rear end plate 39*b* further has a plurality of openings 39*e* formed so as to be positioned between the blades 39*d*. An insulating base 57 is mounted on the front of the stator core 36 as shown in FIG. 2. A rotation sensor 58 is mounted on the insulating base 57 to detect rotation of the rotating tub 14. The rotation sensor 58 comprises a Hall IC disposed opposite the magnets 41. The shaft 44 and the rotor 34 are rotated together. Accordingly, the shaft 44 serves as a rotational shaft of the motor 33. The front end of the shaft 44 is fixed to the rotating tub 14. Accordingly, the shaft 44 serves to connect the motor 33 to the rotating tub 14.

The motor 33 is disposed opposite the working hole 5. The hole 5 has a diameter larger than an outside dimension of the motor 33. Accordingly, when the back panel 6 is detached from the rear wall of the machine, the motor 33 can readily be inspected and repaired through the working hole 5. Further, reference symbol D in FIG. 1 designates a distance between the rear of the tub 8 and the rear wall 4 of the outer cabinet 1. Reference symbols E and F designate distances between the rotor housing 39 and the back panel 6 respectively. A distance between the motor 33 and the rear wall of the outer cabinet 1 and more specifically, the distances E and F are set to be slightly larger than the distance D. As the result of the aforesaid dimensional setting, the reinforcing plate 27 strikes the rear wall 4 of the outer cabinet 1 earlier than the rotor housing 39 does even when the tub 8 swings during washing or dehydration to incline rearward. More specifically, the rear wall 4 serves as a fixed portion which does not swing when the tub 8 swings, and the reinforcing plate 27 serves as a contact portion. Consequently, the rotor housing 39 can be prevented from striking the back panel 6 such that the motor 33 is damaged.

A control device 59 is provided in a front upper interior of the outer cabinet 1 as shown in FIG. 1. The control device 59 is composed of a microcomputer (not shown) and stores a control program for controlling a washing operation and a dehydrating operation. Further, the control device 59 detects an amount of laundry accommodated in the rotating tub 14 and a degree of the unbalanced state of the tub 14 on the basis of the results of detection by the rotation sensor 58.

Upon energization of the motor 33, the rotor 34 thereof is rotated so that the rotational shaft 44 and the rotating tub 14 are rotated. Thus, rotation of the rotor 34 is directly transmitted to the tub 14. Consequently, vibration and noise produced during drive of the motor 33 can be reduced. Further, air is introduced through the openings 39*e* into a space between the rotor 34 and the stator 35 by the blades 39*d* provided on the rotor housing 39. The air flows through the space between the rotor 34 and the stator 35 such that heat generated by the motor 33 is radiated. Consequently, an increase in the temperature of the motor 33 can be restrained.

The recess 31 is formed in the rear wall of the water tub 8 so as to correspond to a space where the motor 33 is to be located. Substantially the front half of the motor 33 is located in the recess 31. Accordingly, the rear wall 4 of the outer cabinet 1 can be brought close to the outer face of the rear wall of the water tub 8 while the space necessary for the motor 33 is ensured. Consequently, the depth of the outer cabinet 1 as shown by reference symbol H1 in FIG. 1 can be reduced as compared with that in the conventional drum type washing machine in which a driven pulley, a transmission belt, etc. are provided in the rear of the water tub.

The back panel 6 has the convexity 7 in which the rear portion of the motor 33 is located. Accordingly, the rear wall 4 of the outer cabinet 1 can be brought close to the outer face of the rear wall of the water tub 8 to the extent that the motor 33 is located in the convexity 7. Consequently, the depth of the outer cabinet 1 can further be reduced. In this case, the depth H2 in FIG. 1 or the dimension from the front end of the machine to the rear end of the rear panel 6 is larger by the convexity 7 than that between the front end of the machine and any other portion of the rear panel. However, since the depth of the lower portion of the outer cabinet 1 is reduced, the washing machine can be installed in a smaller space.

The recess 25 formed in the rear end plate 15 of the rotating tub 14 reduces the capacity of the tub. In the drum type washing machine, however, the laundry moves along the inner surface of the circumferential wall 24*d* of the rotating tub 14 which is rotated in the washing and dehydrating operations. Accordingly, an amount of laundry accommodated in the rotating tub 14 is not almost reduced even when the rear end plate 15 of the tub 14 has the recess 25.

Figure 4:
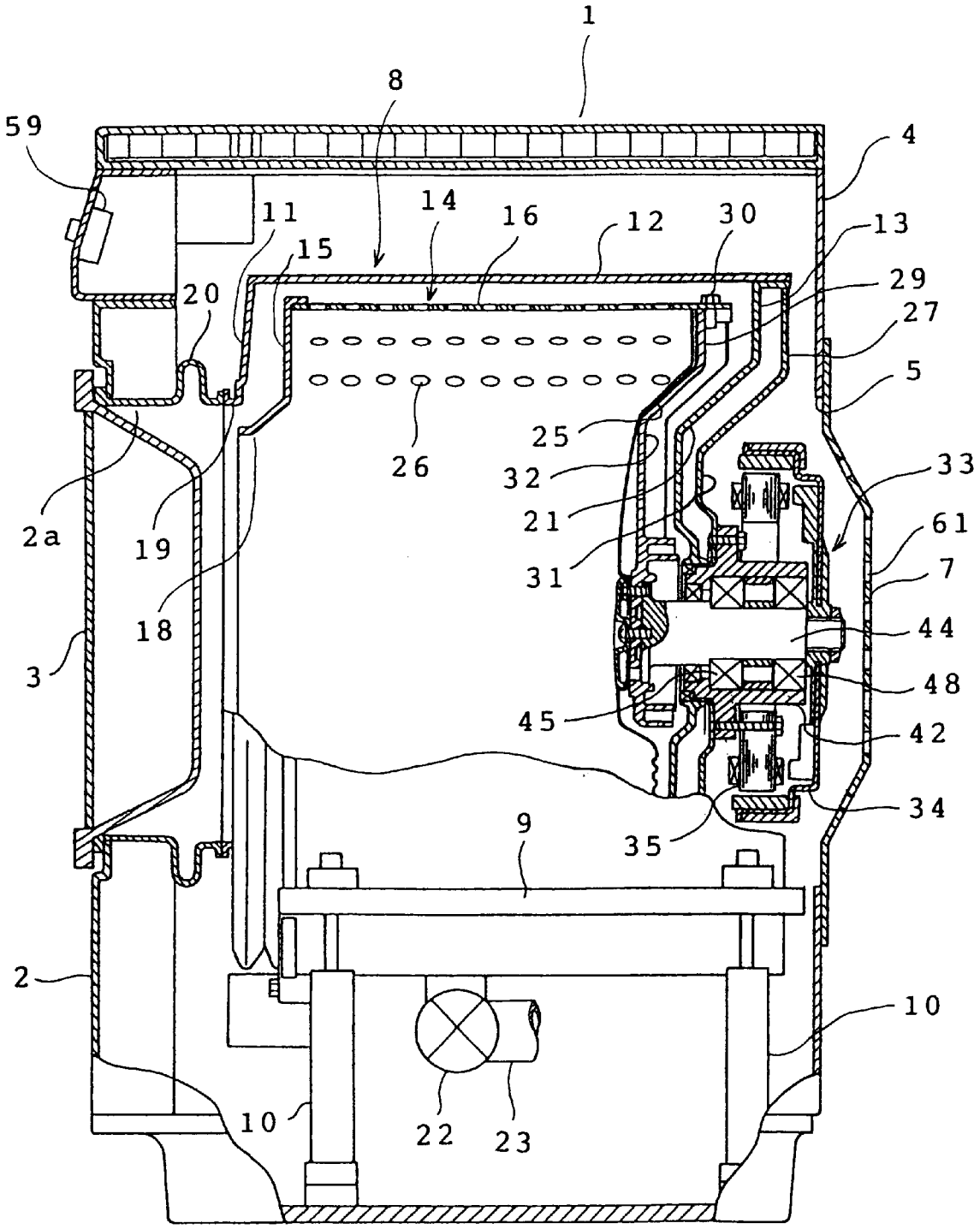
FIG. 4 is a view similar to FIG. 1, showing the drum type washing machine in accordance with at least one embodiment of the invention.

FIG. 4 illustrates a second embodiment of the invention. Only the difference between the first and second embodiments will be described. Identical or similar parts in the second embodiment are labeled by the same reference symbols as in the first embodiment. The back panel 6 is formed with a plurality of vent holes 61 each of which includes a number of small holes (not shown). Upon drive of the motor 33, the blowing action of the blades 39*d* introduces air from a space between the rotor housing 39 and the back panel 6 into the space between the rotor 34 and the stator 35. Further, air outside the cabinet 1 is introduced through the vent holes 61 to the interior thereof and air inside the cabinet is discharged out of it through the vent holes. Consequently, heat generated by the motor 33 can efficiently be radiated and accordingly, the cooling performance can be improved. In particular, since the motor 33 is disposed in a space defined by the recess 21 and the convexity 7 in the cabinet 1, hot air tends to fill the space. However, the hot air can be discharged through the vent holes 61 outside the cabinet 1 in the second embodiment.

Figure 5:
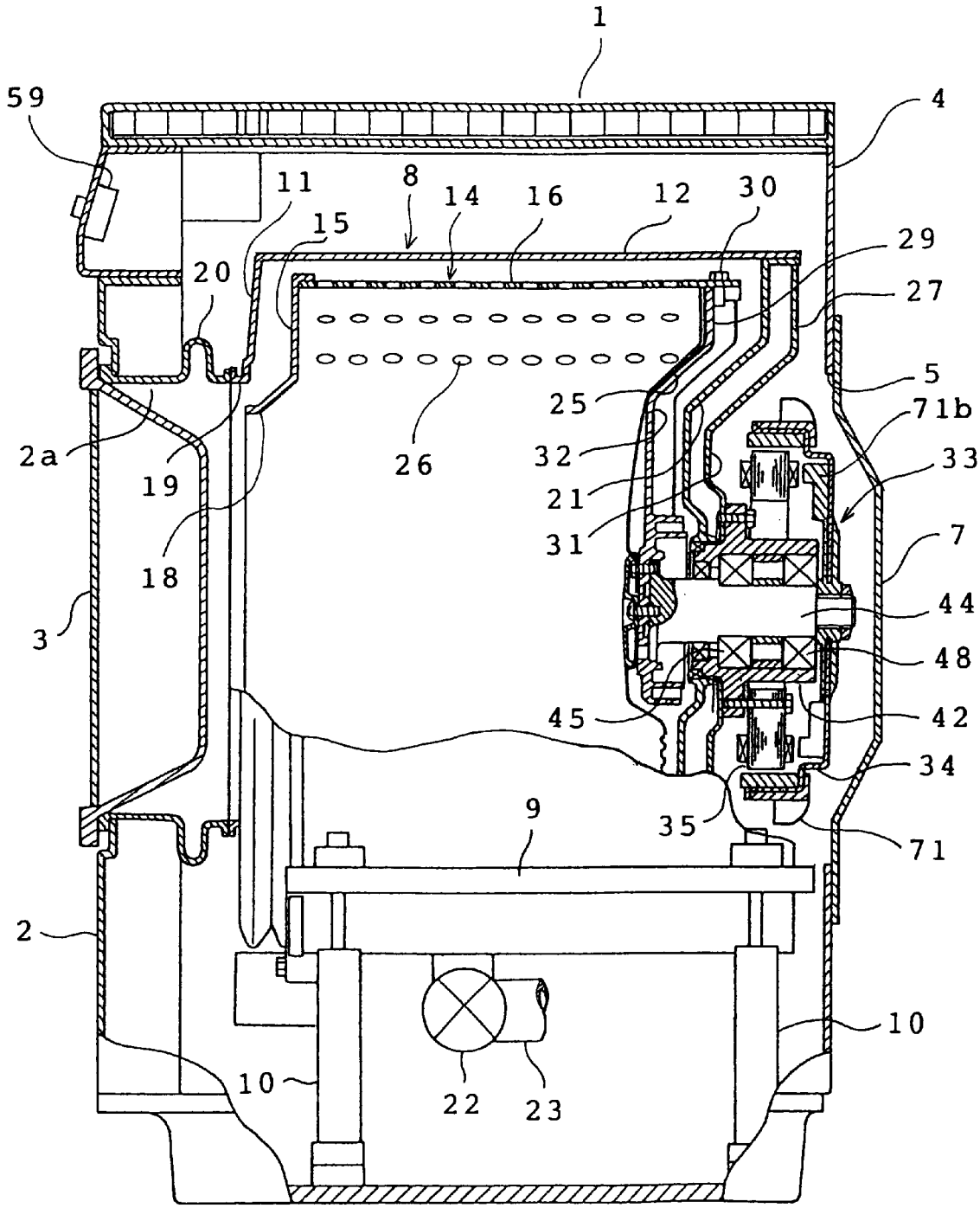
FIG. 5 is a view similar to FIG. 1, showing the drum type washing machine in accordance with at lease one embodiment of the invention.

FIG. 5 illustrates a third embodiment of the invention. Only the difference between the first and third embodiments will be described. The outer circumferential face of the circumferential portion 39*a* of the rotor housing 39 has a plurality of blowing blades 71 in addition to the blades 39*b*. The blades 71 are formed integrally with the rotor housing 39 and serve as centrifugal blowing blades.

The blades 71 are rotated upon rotation of the motor 33 such that air around the motor is agitated. Accordingly, heat radiation from the motor 33 by the air flowing around the motor 33 is enhanced. Consequently, the motor 33 can be cooled more efficiently. The vent holes. 61 as provided in the second embodiment may be formed in the back panel 6 in the third embodiment. This further improves the cooling efficiency.

Figure 6:
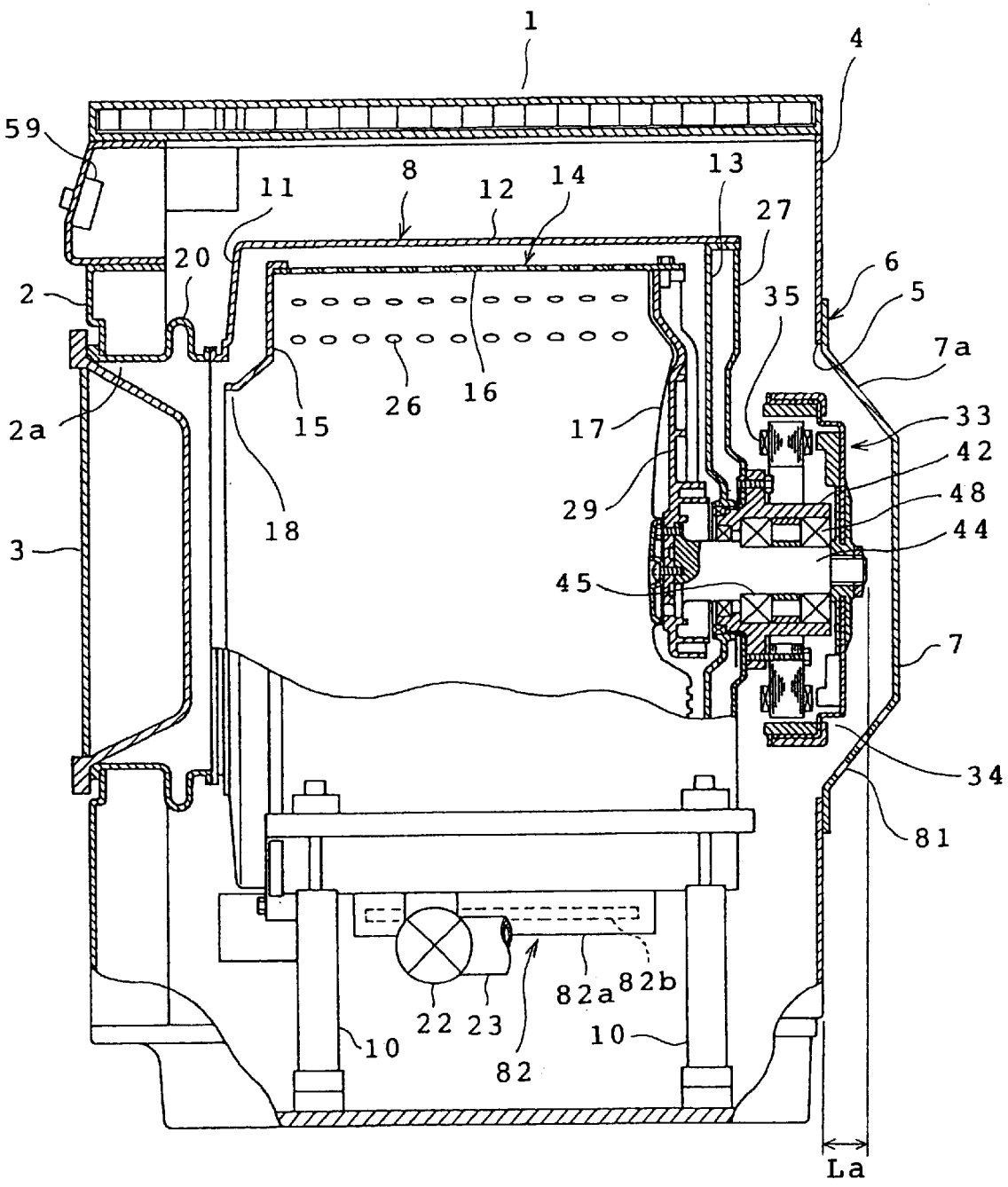
FIG. 6 is a view similar to FIG. 1, showing the drum type washing machine in accordance with at least one embodiment of the invention.
Figure 7:
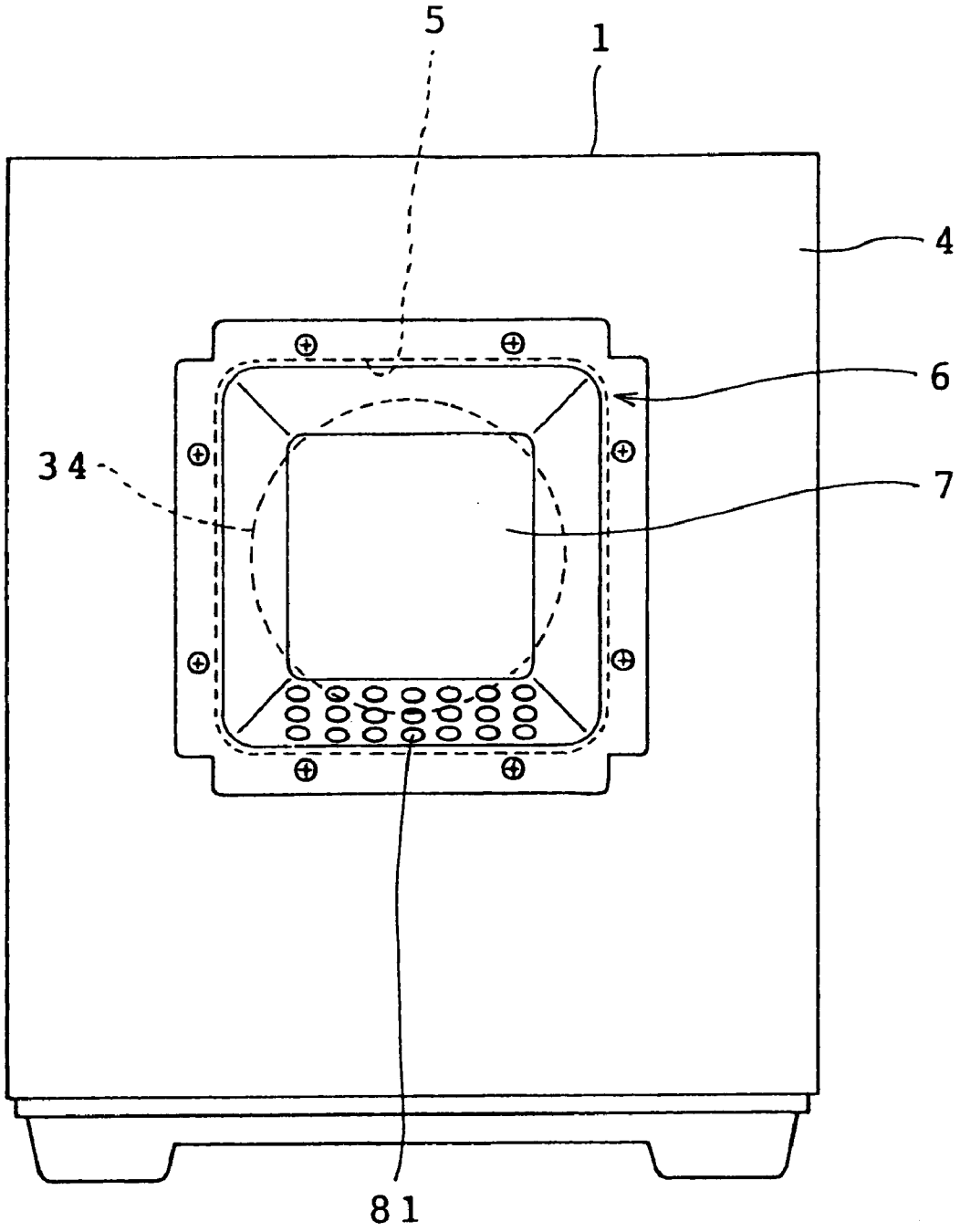
FIG. 7 is a rear view of the drum type washing machine.

FIGS. 6 and 7 illustrate a fourth embodiment of the invention. Only the difference between the first and fourth embodiments will be described. The convexity 7 in the fourth embodiment has a larger depth than that in the first embodiment. The lower portion of the peripheral wall 7*a* of the convexity 7 has a number of generally circular holes 81.

The rear end plate 13 of the water tub 8, the reinforcing plate 27, the rear end plate 16 of the rotating tub 14 and the support 29 are formed to be generally flat. In other words, the rear end plates 13 and 16, the support 29 and the reinforcing plate 27 have no recesses 21, 31, 25 and 32 respectively. Generally a rear half of the motor 33 is located in the convexity 7. More specifically, the axial dimension (shown by La in FIG. 6) of the portion of the motor 33 located in the convexity 7 is set so that the depth H1 of the outer cabinet 1 is below 540 mm. This dimension corresponds to the size (540×540) of a waterproof pan usually used for installation of automatic washing machines including drum type washing machines. The drum type washing machine has the same transverse dimension as the conventional washing machines. Accordingly, even when the rear face of the water tub 8 is flat, the depth of the cabinet 1 and in particular, that of the lower portion of the cabinet 1 can be reduced. Further, a heater 82 serving as heating means is provided on the lower circumferential wall of the water tub 8. The heater 82 comprises a casing 82*a* mounted by screws (not shown) on the water tub 8 and a heating element 82*b*, such as a sheathed heater, accommodated in the casing 82*a*. The heater 82 applies heat to the water in the water tub 8 so that the water is made into hot water.

The heater 82 is energized in the washing or dehydrating operation so that the water in the water tub 8 is heated. In this case, air around the heater 82 is also heated such that the heated air flows upward in the casing 1. Accordingly, since the hot air fills the convexity 7, there is a possibility that the resultant heat may adversely affect the motor 33 and the bearings 45 and 48. In the embodiment, however, air is introduced into and discharged out of the casing 1 through the holes 81. Consequently, since the hot air is prevented from filling the convexity 7, the motor 33 and the bearings 45 and 48 can be prevented from being adversely affected by the heat. Particularly in the fourth embodiment, the holes 81 are formed in the lower portion of the convexity 7. Accordingly, even when water splashes on the convexity 7 from above, the water can be prevented from entering the casing 1 through the holes 81 to wet the motor 33.

Figure 8:
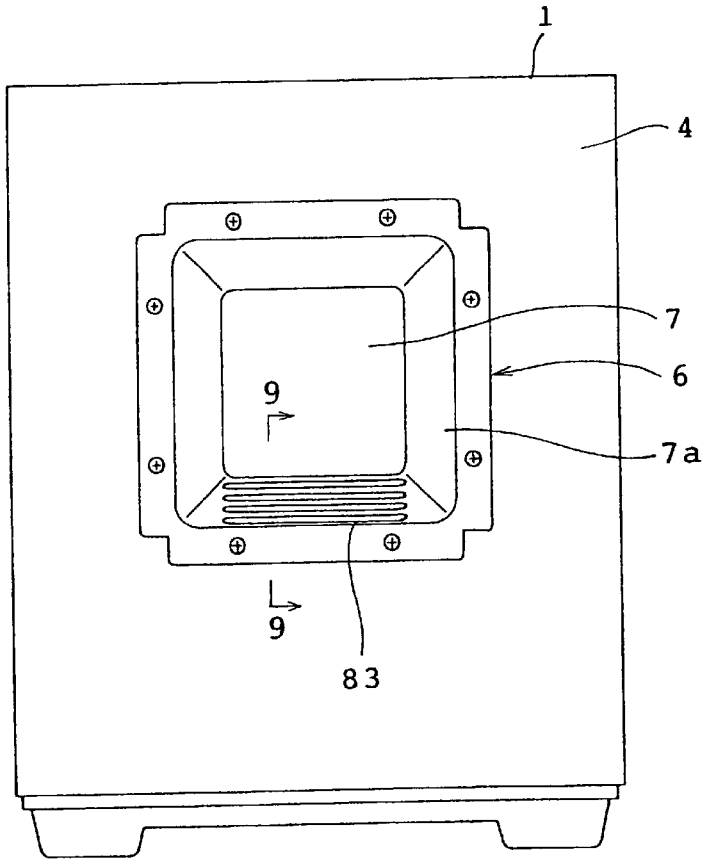
FIG. 8 is a view similar to FIG. 7, showing the drum type washing machine in accordance with at least one embodiment of the invention.
Figure 9:
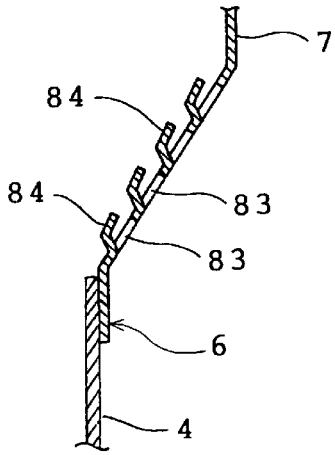
FIG. 9 is a longitudinal section taken along line 9—9 in FIG. 8.

FIGS. 8 and 9 illustrate a fifth embodiment of the invention. Only the difference between the fourth and fifth embodiments will be described. A plurality of horizontally elongated holes 83 are formed in the lower portion of the peripheral wall 7*a* of the convexity 7, instead of the holes 81, as shown in FIG. 8. The convexity 7 further has integrally formed louvers 84 extending from lower edges of the respective holes 83 upward in the interior of the cabinet 1 as shown in FIG. 9.

According to the above-described construction, the louvers 84 can further prevent water from entering the cabinet 1 through the holes 83. Further, sound due to operation of the motor 33 might leak out of the holes 83. However, the louvers 84 can reduce an amount of the sound leaking out of the holes 83. Consequently, an amount of noise produced by the overall machine can be reduced. Additionally, the louvers 84 can prevent foreign matters from entering the cabinet 1 through the holes 83.

Figure 10:
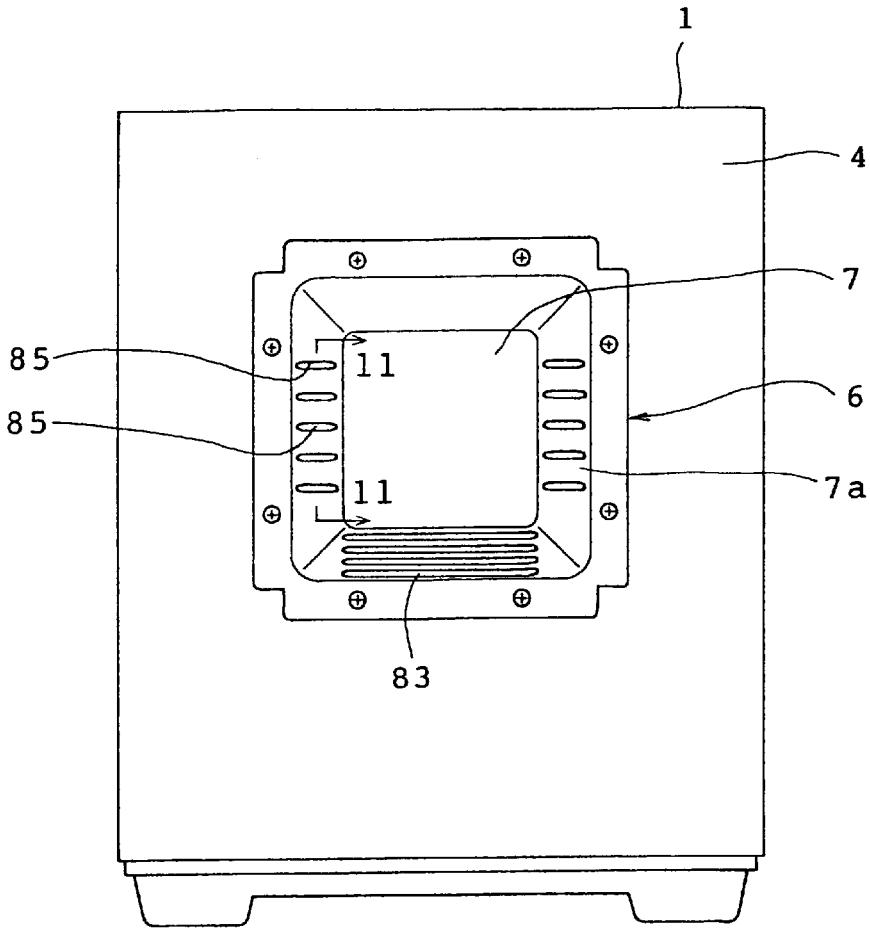
FIG. 10 is a view similar to FIG. 7, showing the drum type washing machine in accordance with at least one embodiment of the invention.
Figure 11:
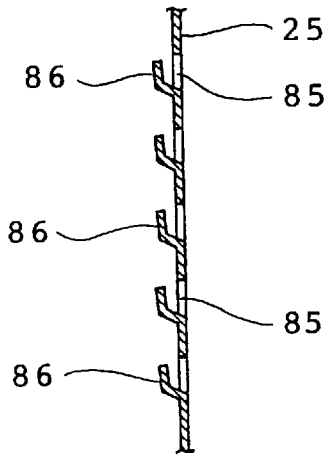
FIG. 11 is a longitudinal section taken along line 11—11 in FIG. 10.

FIGS. 10 and 11 illustrate a sixth embodiment of the invention. Only the difference between the fifth and sixth embodiments will be described. Each of opposite sides of the peripheral wall 7*a* of the convexity 7 is formed with a plurality of holes 85 and louvers 86. Since this construction further increases an amount of air flowing into and out of the cabinet 1 through holes 85, the heat radiation for the motor 33 and the bearings 45 and 48 can further be improved.

Figure 12:
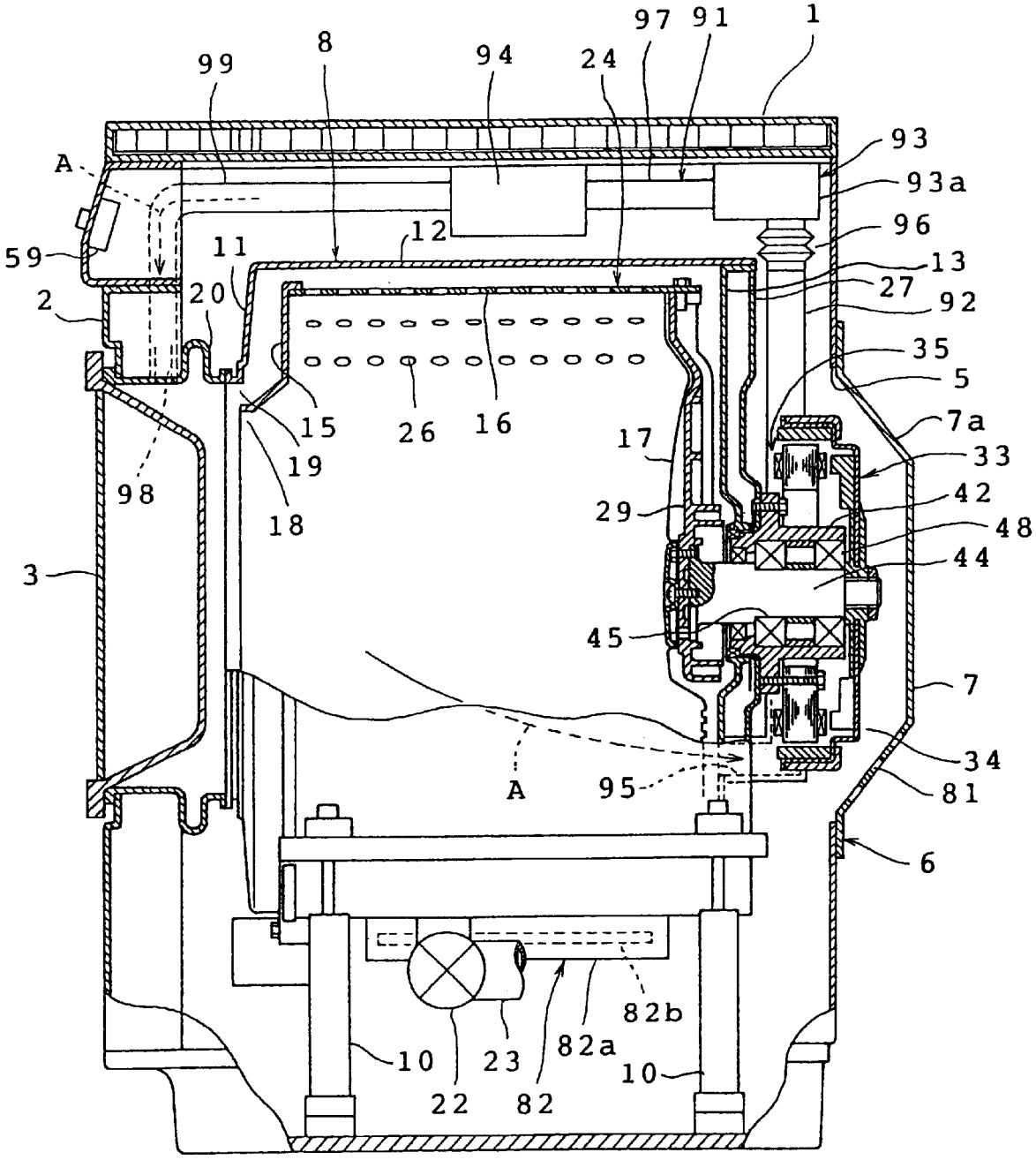
FIG. 12 is a view similar to FIG. 6, showing the drum type washing machine in accordance with at least one embodiment of the invention.

FIG. 12 illustrates a seventh embodiment of the invention. Only the difference between the fourth and seventh embodiments will be described. The drum type washing machine of the seventh embodiment is incorporated with a drier 91. The drier 91 comprises a heat exchanger 92, a fan 93 and a heater 94. The heat exchanger 92 is disposed in the rear of the water tub 8. An electromagnetic water-supply valve (not shown) is provided for supplying water for moisture condensation into the heat exchanger 92. The fan 93 comprises a fan casing 93*a,* an impeller and a fan motor the latter two of which are enclosed in the fan casing. The fan 93 is disposed over the rear of the water tub 8. The heater 94 comprises a heating element (not shown) and is disposed over the central top of the water tub 8.

The rear end plate 13 of the water tub 8 has a hot air return hole 95. One of two ends of the heat exchanger 92 is connected to the hot air return hole 95. The other end of the heat exchanger 92 is connected via a bellows duct 96 to a suction side of the fan 93. The fan 93 includes a discharge side connected via a duct 97 to the heater 94. The bellows 20 have a hot air discharge hole 98 connected via a duct 99 to the heater 94.

The rotating tub 24 serves as a drying drum as well as a washing tub and a dehydrating tub in the embodiment. More specifically, the drier 93 is driven with rotation of the tub 24 in a drying operation and the heating element of the heater 94 generates heat. As a result, air in the tub 24 is sucked through the hot air return hole 95 into the heat exchanger 92 as shown by arrow A in FIG. 12. The air sucked into the heat exchanger 92 is returned through the duct 96, the fan 93, the duct 97, the heater 94, the duct 99 and the discharge hole 98 into the water tub 8, that is, into the rotating tub 24. As the result of the aforesaid air circulation, air in the tub 24 is heated and dehumidified so that laundry is dried in the tub.

The drier 91 is provided as a heat source in addition to the heater 82 in the above-described construction. Accordingly, the temperature in the casing 1 is increased such that the motor 33 and the bearings 45 and 48 might be adversely affected by the resultant heat. In the above-described construction, however, air flows into and out of the casing 1 through the holes 81 of the convexity 7 of the rear panel 6. Consequently, since heat radiation is desirably performed, an increase in the temperature of the motor 33 can be restrained.

The heat exchanger 92 is disposed in the rear of the water tub 8 in the seventh embodiment. When the tub 8 swings to be inclined rearward, the heat exchanger 92 is brought into contact with the rear wall 4 of the cabinet 1 earlier than the motor 33. Accordingly, the heat exchanger 92 serves as a contact portion.

In a modified form, substantially the overall motor 33 may be located in the recess 31. In this case, the rear panel 6 is preferably formed into a flat shape. In each of the fourth to seventh embodiments, a recess may be formed in the rear wall of the water tub 8 and the motor may be located in the recess. A motor of the inner rotor type may be used instead of the motor 33 of the outer rotor type. The motor should not be limited to those of the radial gap type in which a rotor and a stator is radially opposite to each other. The motor may be of the axial gap type in which a rotor and a stator are axially opposite to each other.

Foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A drum type washing machine comprising:

an outer cabinet having a rear wall;

a water tub elastically mounted in the cabinet and having a rear wall;

a drum type rotating tub provided in the water tub so as to be rotatable about a horizontal axis;

an electric motor provided on the rear wall of the water tub to directly drive the rotating tub;

a fixed portion prevented from swinging when the motor is driven; and a contact portion coming into contact with the fixed portion earlier than the motor when the motor is driven such that the water tub swings, the contact portion being provided on the water tub or a member fixed to the water tub except the motor;

wherein a distance between a portion of the rear wall of the water tub on which the motor is provided and a rear wall of the cabinet is larger than a distance between another portion of the rear wall of the water tub and the rear wall of the cabinet.

2. The drum type washing machine according to claim 1, wherein the portion of the rear wall of the water tub on which the motor is provided is formed into the shape of a recess.

3. The drum type washing machine according to claim 2, wherein the motor comprises an outer rotor type motor.

4. The drum type washing machine according to claim 2 wherein a distance between the motor and the rear wall of the cabinet is larger than a distance between the rear wall of the water tub except the portion on which the motor is provided and the rear wall of the cabinet.

5. The drum type washing machine according to claim 2, further comprising a rotational shaft connecting the rotating tub and the motor to each other and a bearing supporting the rotational shaft, wherein the bearing has a portion located inside a stator of the motor.

6. The drum type washing machine according to claim 2, wherein the rear wall of the cabinet includes a portion opposed to the motor and formed with a vent hole.

7. The drum type washing machine according to claim 2, wherein the motor includes a rotor provided with a plurality of blowing blades for a cooling operation.

8. The drum type washing machine according to claim 1, wherein the motor comprises an outer rotor type motor.

9. The drum type washing machine according to claim 1 wherein a distance between the motor and the rear wall of the cabinet is larger than a distance between the rear wall of the water tub except the portion on which the motor is provided and the rear wall of the cabinet.

10. The drum type washing machine according to claim 1, further comprising a rotational shaft connecting the rotating tub and the motor to each other and a bearing supporting the rotational shaft, and wherein the bearing has a portion located inside a stator of the motor.

11. The drum type washing machine according to claim 1, wherein the rear wall of the cabinet includes a portion opposed to the motor and formed with a vent hole.

12. The drum type washing machine according to claim 1, wherein the motor includes a rotor provided with a plurality of blowing blades for a cooling operation.

13. The drum type washing machine according to claim 1, wherein the rear wall of the cabinet has an opening, and further comprising a back panel detachably attached to the cabinet so as to close the opening, the back panel including a portion opposed to the motor and formed with an outwardly protruding convexity.

14. The drum type washing machine according to claim 13, further comprising a unit configured to heat provided on a lower portion of the water tub for heating water reserved in the water tub and a hole formed in a lower portion or a side of the convexity of the back panel so as to communicate with an interior and an exterior of the cabinet.

15. The drum type washing machine according to claim 14, wherein the hole is provided with a louver.

16. The drum type washing machine according to claim 13, wherein the motor includes a portion located in the convexity.

17. The drum type washing machine according to claim 13, wherein the back panel is pressed so that the convexity is tapered and the convexity has a hole formed in a lower portion or a side of a peripheral wall thereof so as to communicate with an interior and an exterior of the cabinet.

18. The drum type washing machine according to claim 1, wherein the cabinet includes a lower portion having a depth set at or below 540 mm.

* * * * *

UNITED STATES PATENT AND TRADEMARK OFFICE

CERTIFICATE OF CORRECTION

PATENT NO. : 6,564,594 B1
DATED : May 20, 2003
INVENTOR(S) : Ito et al.

It is certified that error appears in the above-identified patent and that said Letters Patent is hereby corrected as shown below:

Title page,
Items [22], [30], [86] and [87] are added as follows:

-- [22] PCT Filed: February 9, 2000

[86] PCT No. PCT/JP00/00713

§ 371 Date: November 9, 2000

§ 102(e) Date: November 9, 2000

[87] PCT Pub. No.: WO00/53837

PCT Pub. Date: September 14, 2000

[30] Foreign Application Priority Data

| | | |
|---|---|---|
| Mar. 10, 1999 [JP] | Japanese Pat. Off. | 11-63435 |
| Mar. 24, 1999 [JP] | Japanese Pat. Off. | 11-79713 -- |

Signed and Sealed this

Sixteenth Day of December, 2003

JAMES E. ROGAN
*Director of the United States Patent and Trademark Office*